US009899012B2

(12) United States Patent
First

(10) Patent No.: US 9,899,012 B2
(45) Date of Patent: Feb. 20, 2018

(54) THUMB-MOUNTABLE SUPPORT FOR ENHANCING SUPPORT AND CONTROL OF AN INSTRUMENT OF THE VIOLIN-FAMILY

(71) Applicant: Craig First, Concord, MA (US)

(72) Inventor: Craig First, Concord, MA (US)

( * ) Notice: Subject to any disclaimer, the term of this patent is extended or adjusted under 35 U.S.C. 154(b) by 0 days.

(21) Appl. No.: 15/075,478

(22) Filed: Mar. 21, 2016

(65) Prior Publication Data

US 2017/0270901 A1 Sep. 21, 2017

(51) Int. Cl.
*G10D 1/02* (2006.01)
*G10G 5/00* (2006.01)

(52) U.S. Cl.
CPC ..... *G10G 5/005* (2013.01)

(58) Field of Classification Search
CPC ..... G10G 5/005
USPC ..... 84/280; 473/206, 458; D24/206; D2/623; D29/113
See application file for complete search history.

(56) References Cited

U.S. PATENT DOCUMENTS

| | | | | |
|---|---|---|---|---|
| 776,434 | A | 11/1904 | Smith | |
| 992,765 | A | 5/1911 | Garrett | |
| 1,144,194 | A | 6/1915 | Hamlin | |
| 1,422,827 | A | 7/1922 | Brown | |
| 1,483,595 | A | 2/1924 | Read | |
| 1,753,006 | A | 4/1930 | Haaf | |
| 1,775,472 | A | 9/1930 | Ostrovsky | |
| 1,824,901 | A | 9/1931 | Kessler | |
| 1,886,070 | A | 11/1932 | Weber | |
| 2,477,365 | A | 7/1949 | Dissinger | |
| 3,631,754 | A | 1/1972 | Kun | |
| 4,461,043 | A * | 7/1984 | Lomedico | A63B 71/143 2/16 |
| 4,796,302 | A | 1/1989 | Davis et al. | |
| 5,020,158 | A | 6/1991 | Capone | |
| 5,749,097 | A | 5/1998 | Garrett-Roe | |
| 6,410,832 | B1 | 6/2002 | Sterner | |
| 6,887,212 | B2 | 5/2005 | Bennett | |

(Continued)

FOREIGN PATENT DOCUMENTS

| | | | |
|---|---|---|---|
| WO | 2005117774 | A1 | 12/2005 |
| WO | 2014072669 | A1 | 5/2014 |

OTHER PUBLICATIONS

Website: http://www.archeryacademy.com.au/index.php/page/shop/flypage/product_id/1024/category_id/offset/1125?ps_session=6c9576877d5515db0911f602f0f11e53 Downloaded Aug. 28, 2014 Wedgtail Finger Sling Soft nylon sling which fits over thumb and a finger to allow a relaxed bow grip.

(Continued)

*Primary Examiner* — Jianchun Qin
(74) *Attorney, Agent, or Firm* — Russ Weinzimmer & Associates, PC

(57) ABSTRACT

A thumb-mountable support is disclosed for use on a support hand of a musician while playing an instrument of the violin-family. The thumb-mountable support includes a thumb ring and a saddle. The thumb ring is configured to at least partially surround the thumb of the support hand to facilitate securement of the thumb-mountable support to the thumb of the support hand. The saddle extends from the thumb ring and includes a lower surface configured to engage a generally V-shaped region formed between a thumb and body of the support hand, and also includes an upper surface configured to support a rear portion of a neck of the instrument.

15 Claims, 5 Drawing Sheets

(56) References Cited

U.S. PATENT DOCUMENTS

| | | | | |
|---|---|---|---|---|
| 7,431,671 | B1 | 10/2008 | Frost | |
| 8,852,033 | B1 * | 10/2014 | Frost | A63B 71/143 2/20 |
| 2008/0314225 | A1 * | 12/2008 | Luo | G09B 15/06 84/280 |
| 2016/0148603 | A1 * | 5/2016 | Anderson | G10G 5/005 84/328 |

OTHER PUBLICATIONS

Website: http://www.rehabmart.com/product/pipdip-straps-4754.html Downloaded Aug. 28, 2014 PIP/DIP Straps.

Website: http://www.thearcheryshop.co.uk/finger-slings/877-gompy-bs-4-thumb-finger-sling.html Downloaded Aug. 28, 2014 Gompy—BS-4 Thumb-Finger Sling.

* cited by examiner

THUMB-MOUNTABLE SUPPORT FOR ENHANCING SUPPORT AND CONTROL OF AN INSTRUMENT OF THE VIOLIN-FAMILY

FIELD

The present invention is generally directed to apparatuses for use with musical instruments of the violin-family, and more particularly to an apparatus for assisting a musician while playing an instrument of the violin-family.

BACKGROUND

Instruments of the violin-family include, for example, violins, violas, and the like. Such instruments are maintained in a proper playing position by: 1) holding the body of the instrument upon the musician's shoulder/collar bone area at the base of the musician's neck; 2) using the musician's support hand to support the neck of the instrument in a manner that allows the fingers of the support hand to access the fingerboard of the instrument; and 3) using a "bowing hand" to hold a separate bow, which produces sounds when stroked across the strings of the instrument.

Holding the instrument in the proper position at its body and neck can present many challenges for the musician. In some instances, the body of the instrument is equipped with a chinrest on its upper surface. When the instrument is resting upon the shoulder/collar bone, the chin is placed upon the chinrest to help secure the body of the instrument in its proper position. However, the back of the instrument often has a contoured surface, which may not sufficiently stabilize the instrument on its own, thereby allowing the body of the instrument to shift during play.

The neck end of the instrument is held by the musician's supporting hand. To this end, the musician forms a V-shaped region between the thumb and knuckle of the index finger. However, the musician does not engage the rear portion of the neck at the bottom of the V-shaped region. Nor does the musician engage the rear portion of the neck with a hand collapsed in such a way as to have the neck supported by the palm of the hand. Rather, the neck of the instrument is supported so that it rests upon the thumb of the support hand to allow the musician to allow the four fingers of the support hand to reach the strings at various positions so as to play the desired notes.

There are several issues with holding the neck of the instrument in this manner. For example, both the thumb and the neck of the instrument are rounded surfaces thereby making it difficult to maintain the thumb at its proper position. Further, the neck of the instrument is typically smooth, and friction between the rear portion of the neck and the support hand may make it difficult to keep them engaged as gravity pulls the neck down off of the thumb toward the bottom of the V-shaped region. These issues are intensified as the hand moves about to finger the notes while playing the instrument. If the support hand becomes too tense in these tasks, it loses a degree of dexterity and freedom of movement in fingering the notes and adding vibrato.

Further, it is desirable that the shoulder of the musician's supporting hand side remain relaxed during play. Otherwise, the musician will experience tension, discomfort, and perhaps fatigue and injury as the instrument is played. This problem may become acute when the instrument is played for extended periods of time, such as during concerts, extended practice sessions, etc.

One device that is used to provide additional support for the instrument and reduce the load upon the support hand is known as a "shoulder rest." This device clamps to the underside of the body of the instrument. The shoulder rest is attached at some distance away from the end of the body of the instrument and rests upon the musician's shoulder to provide upward support. At this position, the shoulder rest becomes somewhat of a fulcrum. The musician's chin is placed upon the chinrest, which provides downward pressure to anchor the instrument in place. By way of the shoulder rest fulcrum, this arrangement reduces the load needed by the support hand to elevate the neck end of the instrument.

However, the issue with a "shoulder rest" is that, as mentioned above, the instrument is often played for extended periods of time, and the weight of the instrument is now partially supported by the clamping action of the chin/neck of the musician, which for many may cause discomfort and tension in the neck. Many musicians also feel that the addition of a shoulder rest that clamps to the back of the violin/viola may impede the free vibration of the instrument due to said clamping action, which may have an effect on the tone of the instrument. Shoulder rests also are known to fall off of the instrument, sometimes during a performance.

SUMMARY

A thumb-mountable apparatus for use on a thumb of a support hand of a musician to provide additional support for the neck instrument while playing a violin-family instrument is disclosed. Many of the problems associated with supporting the neck of the instrument are substantially eliminated and/or reduced thereby.

One exemplary embodiment of the apparatus includes a thumb ring configured to at least partially surround the thumb of the support hand to facilitate securement of the apparatus to the support hand. The exemplary embodiment also includes a saddle extending from the thumb ring and having a lower surface configured to engage a generally V-shaped region formed between a thumb and body of the support hand, and an upper surface configured to accept a rear portion of a neck of the violin-family instrument.

Various other aspects of this exemplary embodiment may include one or more of the following features. The apparatus where the thumb ring is configured to extend from a position proximate or above a first thumb knuckle of the musician and terminate at a position below a second thumb knuckle of the musician to thereby allow tactile contact between the thumb of the musician and the neck of the violin-family instrument. The apparatus where the saddle is configured to extend from the thumb ring and terminate at a position proximate a first knuckle of an index finger of the musician to thereby allow contact between fingers of the musician and a fingerboard of the violin-family instrument. The apparatus where the saddle is formed from resiliently deformable materials having varying densities. The apparatus where the saddle is formed from a resiliently deformable material selected from a group including foam rubber and neoprene. The apparatus where the upper surface of the saddle includes a low-friction enhancement surface disposed to engage the rear portion of the neck of the violin-family instrument to facilitate movement of the support hand along the neck of the violin-family instrument. The apparatus where the low-friction enhancement surface is selected from a group including: a velour material and/or a hook and loop material disposed to engage the rear portion of the neck of the violin-family instrument. The apparatus where the hook and loop material is configured to allow provision of multiple layers at the upper surface of the saddle to adjust a height of the saddle. The apparatus where at least one of the saddle and thumb ring are moldable by the musician.

A further exemplary embodiment of the apparatus includes a thumb ring formed from a first material and configured to at least partially surround the thumb of the support hand to facilitate securement of the apparatus to the support hand, the thumb ring including at least one pair of opposed side straps. The apparatus also includes a saddle formed from a second material and connected to the thumb ring by the at least one pair of opposed side straps, wherein at least a lower portion of the saddle is configured for engaging a generally V-shaped region formed between a thumb and body of the support hand.

Various other aspects of this further exemplary embodiment may include one or more of the following features. The apparatus where the first material and the second material have different densities. The apparatus where the thumb ring is configured to extend from a position proximate or below a first thumb knuckle of the musician and terminate at a position below a second thumb knuckle of the musician to thereby allow tactile contact between the thumb of the musician and a neck of the violin-family instrument. The apparatus where the saddle is configured to terminate at a position below a second knuckle of an index finger of the musician to thereby allow contact between fingers of the musician and a fingerboard of the violin-family instrument. The apparatus where the saddle is configured to terminate proximate a first knuckle of an index finger of the musician. The apparatus further including a low-friction enhancement surface at an upper surface of one or both of the thumb ring and the saddle to facilitate gliding of the apparatus along at least a rear portion of a neck of the violin-family instrument. The apparatus where the saddle is moldable by the musician.

A still further embodiment of the apparatus includes a thumb ring configured to at least partially surround the thumb of the support hand to facilitate securement of the apparatus to the support hand. The apparatus also includes a saddle extending from the thumb ring and having a lower surface configured to engage a generally V-shaped region formed between a thumb and body of the support hand, and an upper surface configured to accept a rear portion of a neck of the violin-family instrument. A moldable structure is configured with the saddle to allow the musician to deform the saddle to a desired contour.

Various other aspects of this still further exemplary embodiment may include one or more of the following features. The apparatus where the moldable structure comprises a thin ductile strip. The apparatus where the thumb ring is configured to extend from a position proximate or below a first thumb knuckle of the musician and terminate at a position below a second thumb knuckle of the musician to thereby allow tactile contact between the thumb of the musician and the neck of the violin-family instrument. The apparatus where the saddle is configured to terminate at a position below a second knuckle of an index finger of the musician to thereby allow contact between fingers of the musician and a fingerboard of the violin-family instrument.

DETAILED DESCRIPTION

Figure 1:
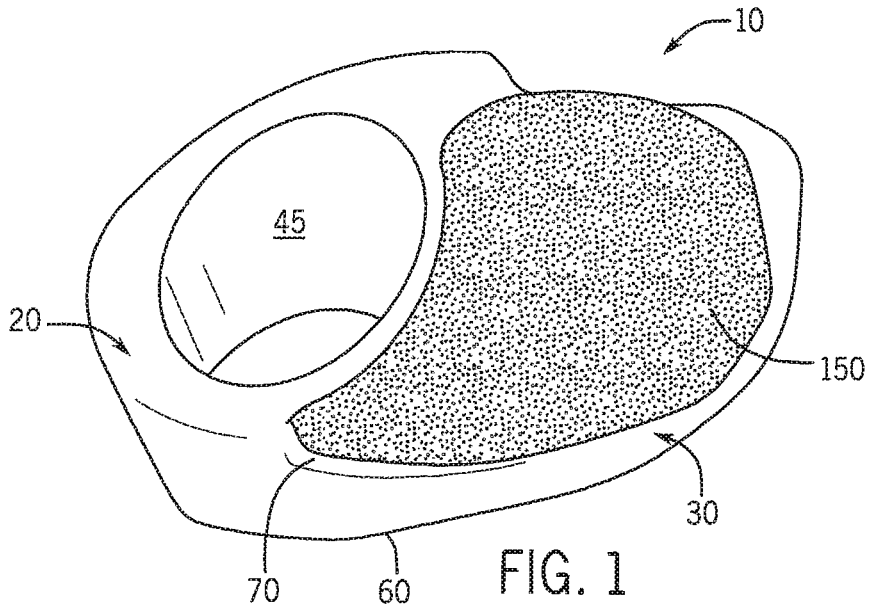
FIG. 1 is a top perspective view of one embodiment of thumb-mountable support for use on a support hand of a musician.

FIG. 1 is a top perspective view of one embodiment of a thumb-mountable support 10 for use with the support hand of a musician. The apparatus 10 is configured for wearing on the thumb of the support hand of a musician while playing a violin-family instrument.

In the embodiment shown in FIG. 1, the apparatus includes a thumb ring 20 and a saddle 30. As shown in FIGS. 2-5, the thumb ring 20 is configured to at least partially surround the thumb 35 of the support hand 40 to facilitate securement of the thumb-mountable support 10 to the thumb of the support hand 40. The thumb ring 20 includes an interior sidewall 45 configured to receive the thumb 35 of the musician. The thumb ring 20 may be formed as a complete thumb ring in which the interior sidewall 45 is continuous and completely surrounds the thumb 35, such as the type shown here. Alternatively, it may be formed as a partial thumb ring in which the interior sidewall 45 is split and discontinuous. In this alternative construction, the interior sidewall 45 of the thumb ring 20 is allowed to spread and contract to accommodate thumbs of various diameters. A strip of ductile material may be disposed about the thumb ring 20 to allow the musician to mold it to a desired size and/or shape.

Figure 2:
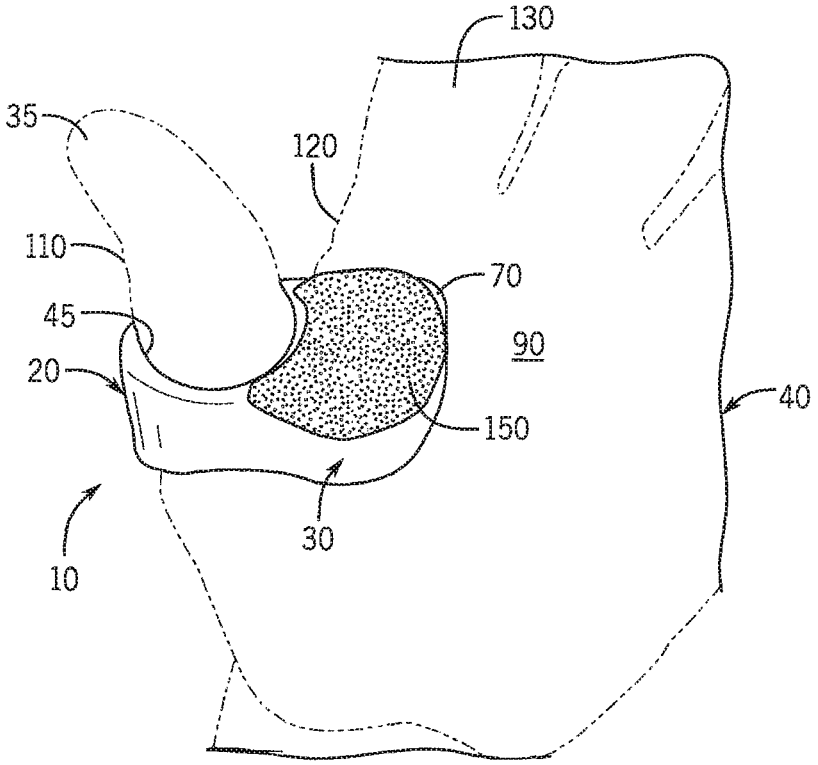
FIG. 2 is a front perspective view of the thumb-mountable support shown in FIG. 1 mounted on the thumb of the support hand of the musician.
Figure 5:
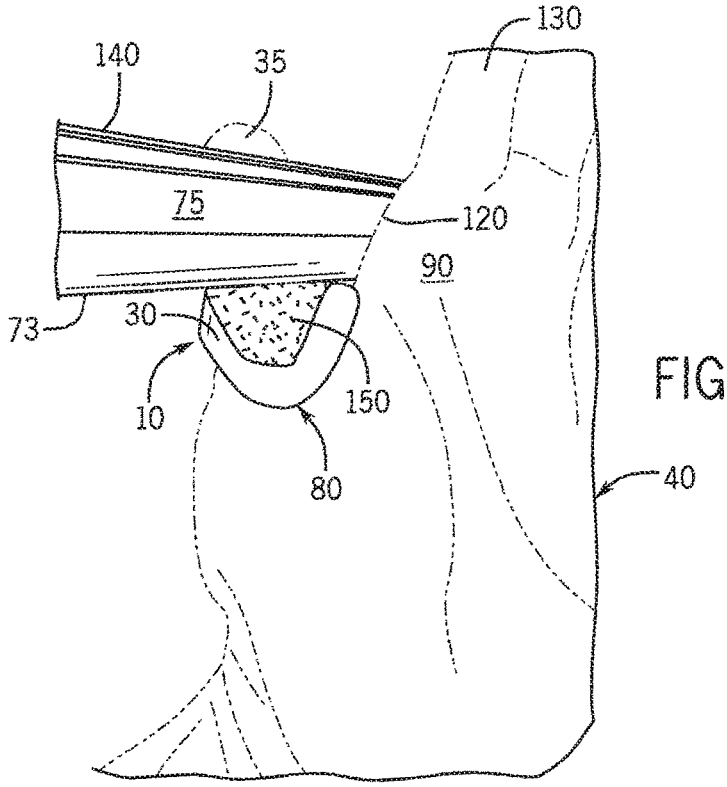
FIG. 5 is a front perspective view of the thumb-mountable support shown in FIG. 1 mounted on the thumb of the support hand of the musician, where the neck of the instrument is engaged by at least a portion of the top surface of the thumb-mountable support.

As also shown in FIG. 1 and FIG. 2, the saddle 30 extends from the thumb ring 20 and has a lower surface 60 and an upper surface 70. With particular reference to FIG. 5, the upper surface 70 is configured to accept a rear portion 73 of a neck 75 of the violin-family instrument, while the lower surface 60 is configured to engage a generally V-shaped region 80 formed between the thumb 35 and body 90 of the support hand 40.

One example of the extent to which the thumb ring 20 and saddle 30 may engage the support hand 40 is shown in FIGS. 2-5. In this embodiment, the thumb ring 20 may be configured to extend from a position proximate or below a first thumb knuckle 100 of the support hand 40 and terminate at a position proximate a second thumb knuckle 110. Here, the thumb ring terminates at a position slightly below the rear portion of the second thumb knuckle 110. It may likewise terminate at a position slightly below the front portion of the second thumb knuckle 110. This configuration allows the thumb 35 to bend about one or both of the first thumb knuckle 100 and/or the second thumb knuckle 110 to thereby allow tactile contact between the thumb 35 and the neck 75.

As also shown in this embodiment, the saddle 30 is configured to extend from the thumb ring 20 and terminate at a position proximate a first knuckle 120 of an index finger 130 of the support hand 40. Here, the upper portion of the saddle 30 terminates at a position slightly below the first knuckle 120 as the musician supports the instrument. This configuration allows the index finger 130, as well as the other fingers of the musician, to contact the fingerboard 140 while playing the instrument.

Figure 3:
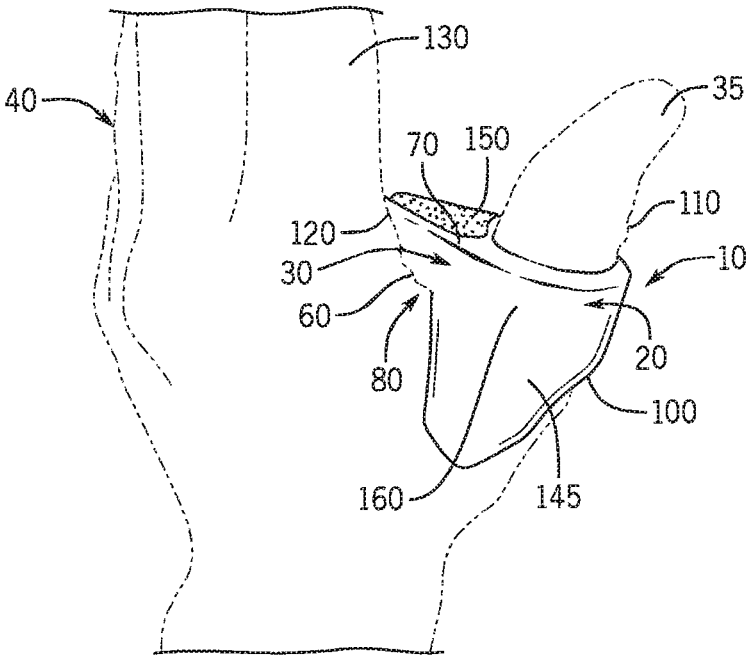
FIG. 3 is a rear perspective view of the thumb-mountable support shown in FIG. 1 mounted on the thumb of the support hand of the musician, where the thumb and index finger of the musician are in a generally vertical position.
Figure 4:
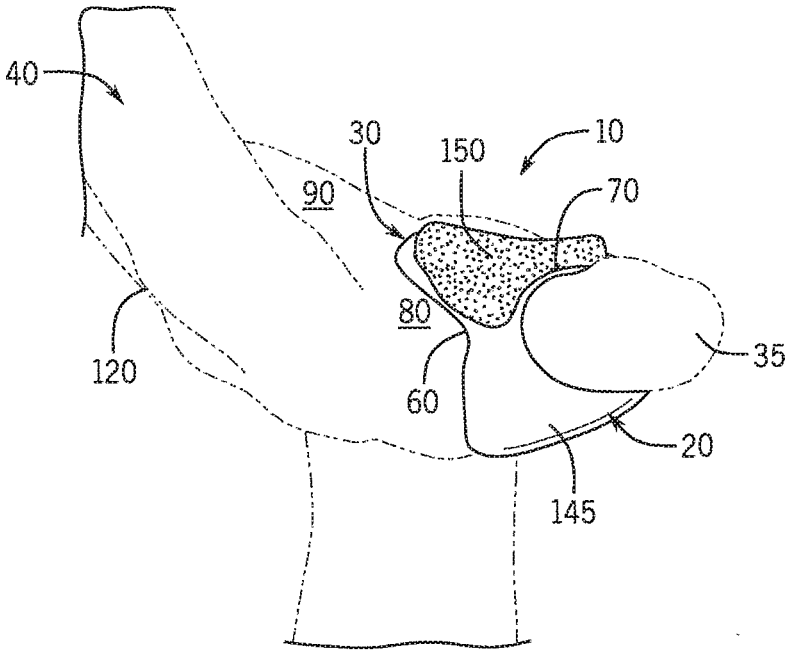
FIG. 4 is a top perspective view of the thumb-mountable support shown in FIG. 1 mounted on the thumb of the support hand of the musician, where the thumb and index finger of the musician are generally separated from one another in a palm up position.

With reference to FIGS. 3 and 4, the thumb-mountable support 10 may further include a resiliently deformable flap 145 that may extend downward from the rear portion of the thumb ring 20. In this embodiment, the resiliently deformable flap 145 forms part of the thumb ring 20 and extends from the principal body portion 160 of the thumb ring 20 to a position below the first thumb knuckle 100. FIG. 3 is a rear perspective view of the thumb-mountable support 10 showing the thumb 35 and index finger 130 of the musician in a generally vertical position. In this state, the resiliently deformable flap 145 prevents the apparatus from rotating from its preferred position on the hand during use. FIG. 4 is a top perspective view of the thumb-mountable support 10 showing the thumb 35 and index finger 130 of the musician separated from one another in a palm up position. In this state, the resiliently deformable flap 145 prevents the apparatus from rotating from its preferred position on the hand during use.

The thumb ring 20 and/or saddle 30 may be constructed from a resiliently deformable material. If the resiliently deformable material is of a type that presents a substantial amount of friction with the material at the rear portion 73 of the neck 75, the upper surface 70 of the saddle 30 and/or thumb ring 20 may be constructed to include a low-friction enhancement surface 150. In such instances, the low-friction enhancement surface 150 is used to lower the friction experienced between the neck 75 and the apparatus 10 as the musician moves the support hand 40 along the neck 75 while playing the instrument. In some embodiments, the low-friction enhancement surface 150 may be formed from a velour material and/or a hook and loop material (i.e., Velcro®). When a hook and loop material is used, multiple layers of the material may be easily added and removed from the low-friction enhancement surface 150 to adjust the height of the saddle 30. In this manner, the spacing between the generally V-shaped region 80 and the rear portion 73 of the neck 75 may be varied to allow the musician to customize the apparatus 10 for optimal support.

Figure 6:
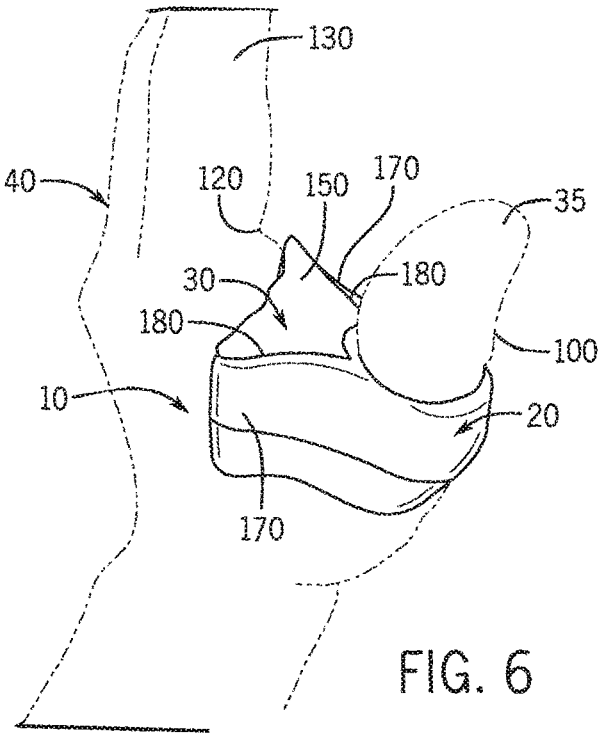
FIG. 6 is a side perspective view of another embodiment of an thumb-mountable support, shown mounted on the thumb of the support hand of the musician.
Figure 7:
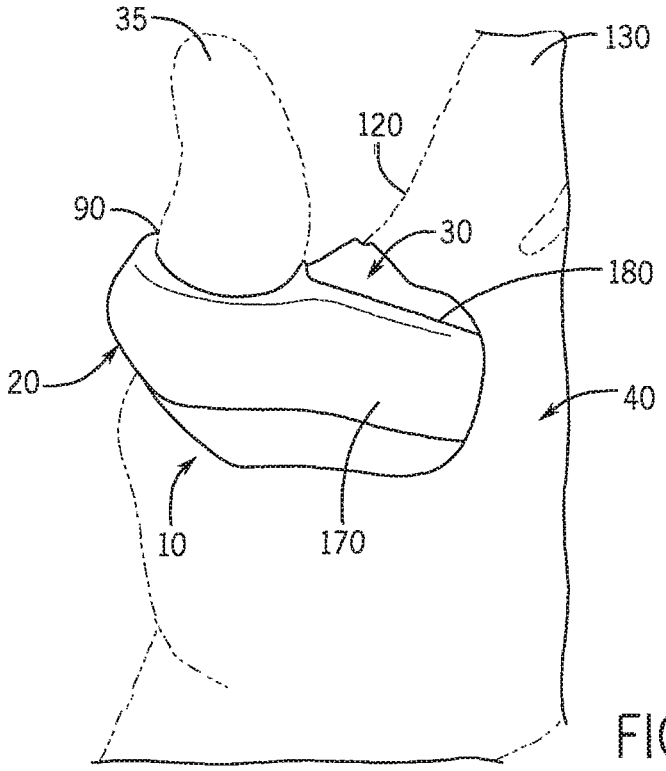
FIG. 7 is a front perspective view of the embodiment of the thumb-mountable support shown in FIG. 6.
Figure 8:
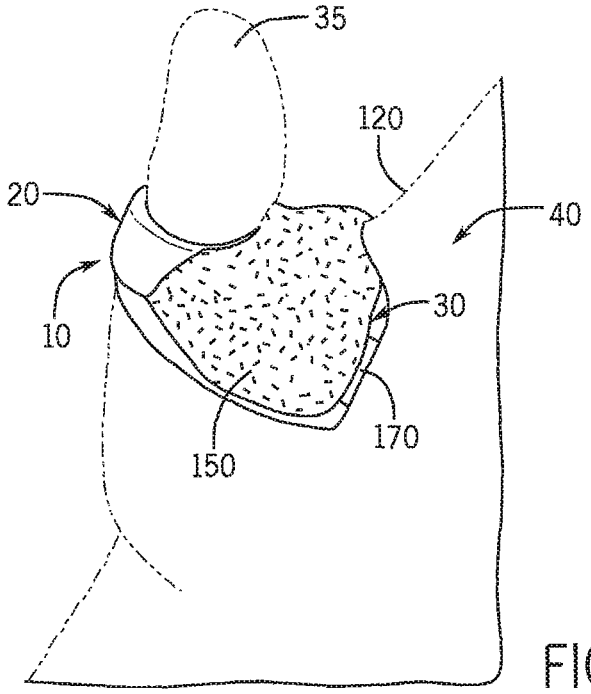
FIG. 8 is a front perspective view of a still further embodiment of a thumb-mountable support mounted on the thumb of the support hand of the musician.

FIGS. 6-8 illustrate another embodiment of the thumb-mountable support 10. In this embodiment, one or both the saddle and/or thumb ring are formed from resiliently deformable materials having varying densities. Higher density materials may be employed to optimize support at various portions of the thumb-mountable support 10, while lower density material may be used in other areas to aid in flexibility and provide comfort to the musician.

With particular reference to FIGS. 6 and 7, the thumb-mountable support 10 includes thumb ring 20 formed from a first material and configured to at least partially surround the thumb 35 to facilitate securement of the apparatus 10 with the support hand 40. In this embodiment, the thumb ring 20 may be formed to include a first material. The thumb ring 20 includes at least one pair of opposed side straps 170 in fixed alignment with opposed exterior walls 180 of the saddle 30. The saddle 30 may be formed from a second material and connected directly to the thumb ring 20 by the opposed side straps 170. In this example, the first material has a density that is higher than the second material. As such, the thumb ring 20 provides substantial support to the thumb 35, while the saddle 30 is more flexible to allow the index finger 130 to move with less effort about the fingerboard 140. The material used to form the saddle 30 and thumb ring 20 may be selected from a wide range of resiliently deformable material, such as foam rubber, neoprene, and the like. Similar to the embodiment shown in FIGS. 1-5, the saddle 30 may be provided with a low-friction enhancement surface 150, placement of which is shown in FIG. 8.

Figure 9:
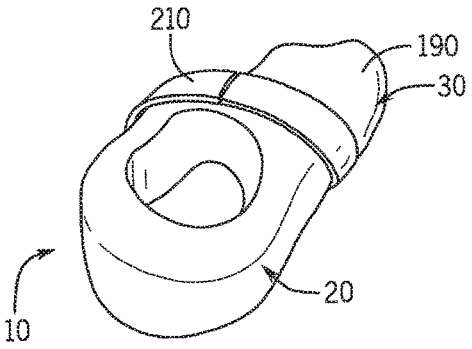
FIG. 9 is a side perspective view of a still further embodiment of the thumb-mountable support for use on the support hand of the musician.
Figure 10:
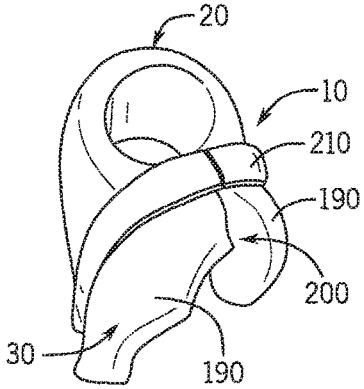
FIG. 10 is a further side perspective view of the embodiment of the thumb-mountable support shown in FIG. 9.

FIGS. 9-12 illustrate yet another embodiment of the thumb-mountable support 10. In this embodiment, the thumb-mountable support 10 includes a moldable structure configured with the saddle 30 to allow the musician to deform the saddle 30 to a desired contour. The moldable structure may be constructed in a number of different manners. Here, as shown in FIGS. 9 and 10, the saddle 30 is split to form opposing structures 190 defining an open groove 200 therebetween. A thin strip 210 of a ductile material extends between the opposing structures 190 and spans the open groove 200. The thin strip 210 may be formed from one or more ductile materials, including a metal, such as copper with heat shrink covering, a moldable putty, etc. In this specific embodiment, the shape of the thin strip 210 may be molded by the musician. The width and shape of the open groove 200 adjusts based on the shape to which the musician molds the thin strip 210. Together, the thin strip 210 and width of the open groove 200 help the musician to configure the saddle 30 to its desired contour.

Figure 11:
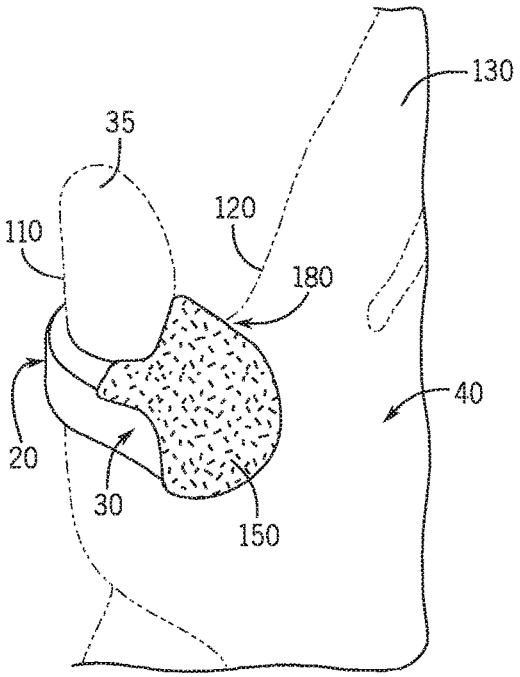
FIG. 11 is a front perspective view of the embodiment of the thumb-mountable support shown in FIGS. 9 and 10 as mounted on the thumb of the support hand of the musician.
Figure 12:
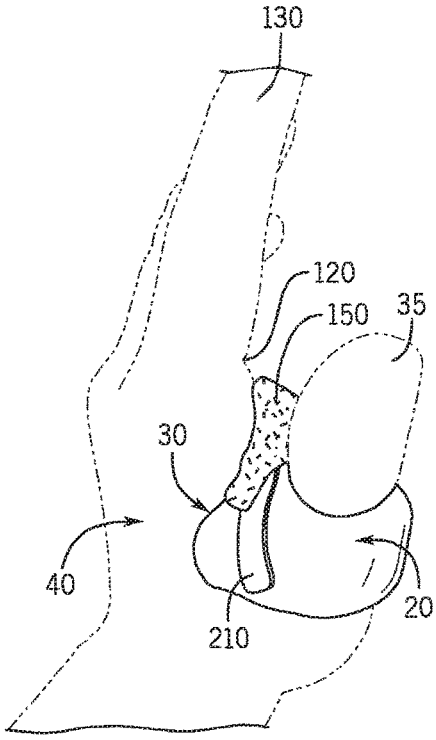
FIG. 12 is a side perspective view of the embodiment of the thumb-mountable support shown in FIGS. 9 and 10 as mounted on the thumb of the support hand of the musician.

FIG. 11 is a front perspective view of the embodiment of the thumb-mountable support shown in FIGS. 9 and 10 as applied to the support hand of the musician, while FIG. 12 shows a side perspective view of the embodiment. Similar to the embodiment shown in FIGS. 1-5, the saddle 30 may be provided with a low-friction enhancement surface 150, placement of which is shown in FIGS. 11 and 12.

In the foregoing specification, specific embodiments have been described. However, it is understood that various modifications and changes can be made without departing from the scope of invention as set forth in the claims below. Accordingly, the specification and figures are to be regarded in an illustrative rather than a restrictive sense, and all such modifications are intended to be included within the scope of present teachings.

The invention claimed is:

1. A thumb-mountable support for use on a support hand of a musician while playing a violin-family instrument, the thumb-mountable support comprising:

a thumb ring configured to substantially surround the thumb of the support hand to thereby secure the thumb-mountable support to the thumb of the support hand;

a resiliently deformable flap extending from a principal body portion of the thumb ring to a position below the first thumb knuckle of the user to inhibit over-extension of the thumb of the support hand while playing the violin-family instrument; and a saddle anchored to the thumb of the support hand by the thumb ring, the saddle having a lower surface configured to engage and substantially span a generally V-shaped region formed between a thumb and body of the support hand, the saddle further having an upper surface configured to substantially span a region between the thumb and a first knuckle of an index finger of the support hand, wherein the upper surface includes a low-friction enhancement surface disposed to engage a rear portion of a neck of the violin-family instrument and provides a primary support surface for the neck.

2. The thumb-mountable support of claim 1, wherein the thumb ring is configured to substantially surround the thumb from a position proximate or above a first thumb knuckle of the musician and terminate at a position below a second thumb knuckle of the musician to thereby allow tactile contact between the thumb of the musician and the neck of the violin-family instrument.

3. The thumb-mountable support of claim 1, wherein the saddle is formed from resiliently deformable materials having varying densities.

4. The thumb-mountable support of claim 1, wherein the saddle is formed from a resiliently deformable material selected from a group comprising foam rubber and neoprene.

5. The thumb-mountable support of claim 1, wherein the low-friction enhancement surface comprises a material layer added to the upper surface of the saddle, wherein the material layer is selected from a group comprising: a velour material, and/or a hook and loop material disposed to engage the rear portion of the neck of the violin-family instrument.

6. The thumb-mountable support of claim 5, wherein the hook and loop material is configured to allow provision of multiple layers at the upper surface of the saddle to adjust a height of the saddle.

7. The thumb-mountable support of claim 1, wherein at least one of the saddle and thumb ring are moldable by the musician.

8. A thumb-mountable support for use on a support hand of a musician while playing a violin-family instrument, the thumb-mountable support comprising:

a thumb ring formed from a first material and configured to substantially surround the thumb of the support hand to thereby secure the thumb-mountable support to the thumb of the support hand, the thumb ring including at least one pair of opposed side straps;

a resiliently deformable flap extending from a principal body portion of the thumb ring to a position below the first thumb knuckle of the user to inhibit over-extension of the thumb of the support hand while playing the violin-family instrument; and a saddle anchored to the thumb of the support hand by the thumb ring, the saddle being formed from a second material and connected to the thumb ring by the at least one pair of opposed side straps, wherein a lower portion of the saddle is configured for engaging and substantially spanning a generally V-shaped region formed between a thumb and body of the support hand, the saddle further including an upper surface substantially spanning a region between the thumb and a first knuckle of an index finger of the support hand, wherein the upper surface includes a low-friction enhancement portion configured to engage a rear portion of a neck of the violin-family instrument and provides a primary support surface for the neck.

9. The thumb-mountable support of claim 8, wherein the first material and the second material have different densities.

10. The thumb-mountable support of claim 8, wherein the thumb ring is configured to substantially surround the thumb from a position proximate or below a first thumb knuckle of the musician and terminate at a position below a second thumb knuckle of the musician to thereby allow tactile contact between the thumb of the musician and a neck of the violin-family instrument.

11. The thumb-mountable support of claim 8, wherein the saddle is moldable by the musician.

12. A thumb-mountable support for use on a support hand of a musician while playing a violin-family instrument, the thumb-mountable support comprising:

a thumb ring configured to substantially surround the thumb of the support hand to thereby secure the thumb-mountable support to the thumb of the support hand;

a resiliently deformable flap extending from a principal body portion of the thumb ring to a position below the first thumb knuckle of the user to inhibit over-extension of the thumb of the support hand while playing the violin-family instrument; and a saddle anchored to the thumb of the support hand by the thumb ring, the saddle having a lower surface configured to engage and to substantially span a generally V-shaped region formed between a thumb and body of the support hand, and an upper surface configured to substantially span a region between the thumb and a first knuckle of an index finger of the support hand, wherein the upper surface includes a low-friction enhancement surface that is configured to accept a rear portion of a neck of the violin-family instrument and form a primary support surface for the neck; and a moldable structure configured with the saddle to allow the musician to deform the saddle to a desired contour.

13. The thumb-mountable support of claim 12, wherein the moldable structure comprises a thin ductile strip.

14. The thumb-mountable support of claim 12, wherein the thumb ring is configured to substantially surround the thumb from a position proximate or below a first thumb knuckle of the musician and terminate at a position below a second thumb knuckle of the musician to thereby allow tactile contact between the thumb of the musician and the neck of the violin-family instrument.

15. The thumb-mountable support of claim 13, wherein the saddle is configured to terminate at a position below a second knuckle of an index finger of the musician to thereby allow contact between fingers of the musician and a fingerboard of the violin-family instrument.

* * * * *